United States Patent [19]

Owen

[11] Patent Number: 4,613,075

[45] Date of Patent: Sep. 23, 1986

[54] ELECTROSTATIC SPRAYING

[75] Inventor: David J. Owen, Cleveland, England

[73] Assignee: Imperial Chemical Industries PLC, London, England

[21] Appl. No.: 624,109

[22] Filed: Jun. 25, 1984

[30] Foreign Application Priority Data

Jul. 15, 1983 [GB] United Kingdom ..... 8319227

[51] Int. Cl.[4] ..... B05B 1/14; B05B 5/02

[52] U.S. Cl. ..... 239/3; 239/696; 239/553.3

[58] Field of Search ..... 239/3, 696, 706, 590.5, 239/707, 708, 337, 690, 553.3; 361/226

[56] References Cited

U.S. PATENT DOCUMENTS

| | | | |
|---|---|---|---|
| 3,630,455 | 12/1971 | Parkison | 239/590.3 X |
| 3,970,222 | 7/1976 | Duffield . | |
| 4,273,293 | 6/1981 | Hastings | 239/705 |
| 4,290,091 | 9/1981 | Malcolm | 361/226 |
| 4,356,528 | 10/1982 | Coffee | 361/226 |

FOREIGN PATENT DOCUMENTS

| | | | |
|---|---|---|---|
| 1486242 | 9/1977 | United Kingdom | 239/706 |

*Primary Examiner*—Andres Kashnikow

*Attorney, Agent, or Firm*—Cushman, Darby & Cushman

[57] ABSTRACT

A multinozzle electrostatic spraying apparatus wherein flow restrictors are provided in the liquid supply paths to the nozzles to render the liquid flow rates through the nozzles more uniform irrespective of the spatial orientation of the apparatus.

12 Claims, 6 Drawing Figures

ELECTROSTATIC SPRAYING

Figure 1:
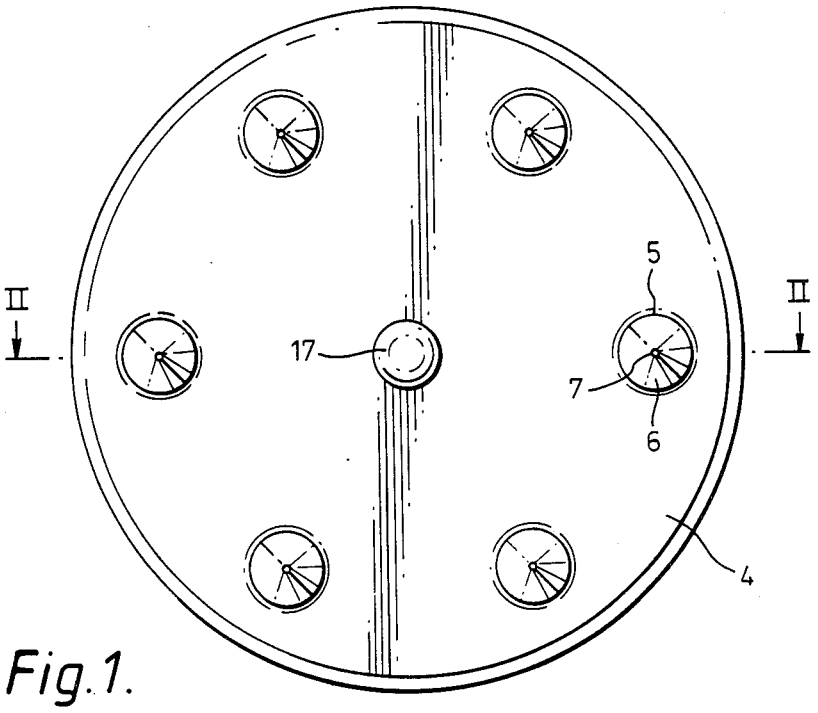

This invention relates to electrostatic spraying. When a poorly conducting liquid, e.g. having an electrical resistivity of the order of $10^5$ to $10^{11}$ chm. cm, is supplied to a nozzle to which a high potential is applied, the liquid will be atomised as fine droplets bearing an electrical charge if the potential gradient at the nozzle is sufficient.

When such a spray is produced in the presence of a target that is earthed, or is at a potential of opposite polarity to the charges on the droplets, the droplets are attracted to the target with the result that the liquid is deposited on the target. At the same time, because of the attraction forces, the amount of liquid missing the target is markedly reduced compared to sprays bearing no charge. In addition to the advantages given by the attraction of the charged droplets to the target, the application of charge also gives a narrower droplet size distribution compared to sprays having no charge.

However satisfactory atomisation, in the absence of any mechanically induced atomisation, is only obtained at relatively low flow rates, generally less than 0.05 ml/s (corresponding to less than $5\times10^{-8}$ $m^3/s$). Increasing the nozzle size and/or applying pressure to increase the rate of flow often results in poor atomisation.

For many applications however such flow rates are inadequate. The flow rate from a given spraying appliance can of course be increased by using a plurality of nozzles: however when a plurality of nozzles is used, it is desirable that the flow rate from each nozzle is substantially the same since the flow rate effects the droplet size distribution obtained at any given applied electrical potential. If the feed of the liqud to the nozzles is effected by gravity, then alteration of the nozzle spatial orientation from the vertical is liable to give rise to unequal flow rates.

When multiple nozzles are employed, it is necessary to space the individual nozzles from one another by such a distance that the electrical field at each nozzle is not unduly affected by that at adjacent nozzles. The required spacing increases as the applied electrical potential increases. Thus at an applied potential of 8–10 kV the nozzles typically should be spaced apart by at least about 5 mm while at an applied potential of 13–15 kV a spacing of at least 7 mm is desirable.

The liquid emerges from each nozzle as one or more ligaments which subsequently break up into droplets. The ligaments from adjacent nozzles carry like electrical charges and so tend to repel one another giving a diffuse spray. For some applications such as paint spraying a diffuse spray is undesirable and a "focussed" spray is desired. "Focussing" of the spray can be achieved by positioning the nozzles, preferably symmetrically, around an earthed electrode to modify the electrical field to counteract the repulsive forces between the ligaments.

Because of these constraints the nozzles are thus preferably disposed approximately symmetrically round the circumference of a circle around a central earthed electrode or in a pair of lines of nozzles with an earthed electrode disposed between the pair of lines; this latter arrangement may be desirable where a fan shaped spray is required.

Also it may be desirable, as described in U.S. Pat. No. 4,356,528 to provide an earthed electrode externally of the nozzle cluster to intensify the electrical field at the nozzles and so improve the electrostatic atomisation.

The requisite spacing of the nozzles from an earthed electrode also increases as the applied potential increases: again a minimum spacing of about 5 mm is required at an applied voltage of 8–10 kV.

For the above reasons it is seen that if a substantial number of, e.g. at least 5, nozzles are employed in order to obtain an adequate overall flow rate, the distance between the furthest spaced nozzles may be several cm.

This may not provide any serious problem if it is desired to spray vertically, or near vertically, downwards but if other spatial orientations are desirable, e.g. in a spray gun for paint spraying where the ability to spray horizontally is necessary, such spacing between the nozzles will give rise to a hydrostatic head when those nozzles are vertically displaced from one another thus tending to give rise to uneven flow rates and hence an uneven droplet spectrum in the resultant spray.

The maximum possible vertical displacement of the nozzles thus equals the distance between the furthest apart nozzles.

We have devised a system whereby this difficulty may be overcome.

Accordingly the present invention provides a method of electrostatically spraying a liquid comprising feeding said liquid from a common source under superatmospheric pressure to a plurality of nozzles so that it flows through each nozzle at a rate not exceeding $5\times10^{-8}$ $m^3 \cdot s^{-1}$ and applying to said nozzles an electrical potential of such magnitude that said liquid emerging from said nozzles is atomised into electrically charged droplets, said liquid being fed to said nozzles via means to distribute said liquid from said common source to said nozzles via flow restricting means disposed at, or downstream of, said flow distributing means, whereby said flow restricting means provides a flow restrictor in each of the paths from said common source to said nozzles, said flow restricting means being such that the pressure drop on said liquid across each of said flow restrictors is substantially greater than that given by the hydrostatic head corresponding to the maximum possible vertical displacement of said nozzles.

In one form of the invention the flow restricting means may comprise a single restricting means, e.g. a felt pad, disposed at the flow distributor arranged such that the liquid flows directly from the felt pad to the nozzles in individual streams. In this case such flow restrictor comprises that part of the flow restricting means between the inlet thereto and the position where the respective individual stream emerges from the flow restricting means.

Alternatively the flow restricting means may consist of a separate flow restrictor, downstream of the flow distributor, in each path from the flow distributor to the nozzle associated with that path.

Such separate flow restrictors may be formed by a fibre bundle disposed in each nozzle so that the liquid has to flow through the interstices of the bundle, or each nozzle may be provided with a core member so that flow is restricted to a narrow gap between the core and the internal bore of the nozzle. Another suitable form of restrictor comprises a fine bore upstream of each nozzle but downstream of the flow dividing means. In some cases the nozzle itself can be made with a bore of sufficiently small cross sectional area, and sufficient length, to provide the necessary pressure drop.

The liquid supply is preferably from a container presurised, e.g. by means of a compressed gas, for example compressed air or carbon dioxide, or a liquified propellant such as a fluorocarbon, to a pressure of at least 70 kPa gauge. It will be appreciated that it is not necessary that all of this pressure need be "dropped" across the flow restricting means of the invention. Thus in one form of the invention the liquid is supplied to the spray head via a primary flow restricting means arranged to determine the overall liquid flow rate: the liquid then flows from this primary flow restricting means to the flow distributor with the secondary flow restricting means disposed at, or downstream of, the flow distributor. In this case the secondary flow restricting means forms the flow restrictors across which is developed the pressure drop required to render insignificant variations in flow rate caused by varying spatial orientations of the spraying apparatus.

The maximum possible vertical nozzle displacement is preferably in the range 3 to 10 cm. As the liquid will generally have a specific gravity in the range of about 1 to 1.5 the pressure corresponding to the maximum hydrostatic head will generally be in the range of 300 to 1500 Pa. The pressure drop across the flow restrictor will depend on the flow rate and on the viscosity of the liquid and is preferably above 2000 Pa and in particular above 4000 Pa.

The pressure drop across the flow restrictor is preferably at least five, and in particular at least ten, times the pressure corresponding to the aforesaid maximum hydrostatic head.

The pressure drop P across a flow restrictor is related to the volumetric flow rate Q, and to the viscosity $\eta$, of the liquid, by the equation $$P=\alpha\cdot Q\cdot\eta.$$

where $\alpha$ is a number whose magnitude depends on the physical nature of the flow restrictor. It will be appreciated that, for any given flow restrictor, $\alpha$ may not be a constant at all flow rates and at all liquid viscosities.

The invention is of particular utility with liquids having a viscosity between $10^{-3}$ and $10^{-1}$ Pa·s., particularly above $10^{-2}$ Pa·s. In order to obtain a sufficient pressure drop across each flow restrictor with such liquids at the low flow rates employed, it is generally necessary that each flow restrictor has a value of $\alpha$ of at least $5\times10^{12}$ $m^{-3}$.

Therefore in accordance with a further aspect of the present invention we provide a spray head for electrostatic spraying having a plurality of nozzles, means to supply liquid to be sprayed to the nozzle, and means to apply a high electrical potential to the liquid emerging from the nozzles, said liquid supply means including means to distribute said liquid, provided under superatmospheric pressure, from a common source, to the nozzles via flow restricting means disposed at, or downstream of, said flow distributing means, whereby said flow restricting means provides a flow restrictor in each of the paths from said common source to the nozzles, and wherein, at least for liquids of viscosity between $10^{-3}$ and $10^{-1}$ Pa·s and at flow rates through said flow restrictor below $5\times10^{-8}$ $m^3\cdot s^{-1}$, each of said flow restrictors has a value of $\alpha$ of at least $5\times10^{12}$ $m^{-3}$ where $\alpha$ is defined as $$\alpha=P/(Q\cdot\eta)$$

where P is the pressure drop, expressed in Pa, given across the flow restrictor by a liquid of viscosity $\eta$ expressed in Pa·s at a flow rate of Q $m^3\cdot s^{-1}$.

The invention is of particular utility for spraying paint composition, e.g. from a hand-held paint spray gun. To obtain an acceptable quality paint finish the maximum nozzle diameter is about 1.5 mm and the maximum flow rate from each nozzle is about 0.03 $ml\cdot s^{-1}$, i.e. $3\times10^{-8}$ $m^3\cdot s^{-1}$. In order to obtain an acceptable overall flow rate, it is preferred that there are at least six, and in particular at least eight, nozzles.

The liquid preferably has a resistivity within the range $10^5$ to $10^{11}$, and in particular between $10^7$ and $10^8$, ohm·cm.

As mentioned hereinbefore, when the liquid is supplied to the nozzles and a high electrical potential is applied thereto, the liquid emerges from each nozzle as one or more ligaments which when break up into the spray of charged droplets. Preferably only one ligament is produced from each nozzle: this may be achieved by providing that the exterior surface of each nozzle is of an approximately hemispherical or bullet-head configuration.

We have found that optimum spraying, with minimum risk of contamination of the operator when the spray head assembly is incorporated into a hand-held spray gun, is achieved when the ligaments from the individual nozzles are arranged to converge towards one another. Such convergence may be achieved by inclining the nozzles inwardly towards one another and/or by the provision of an earthed focussing electrode disposed within the nozzle configuration.

When used in a hand-held spray gun, the atomising potential may be provided by a high voltage generator incorporated into the spray gun, preferably powered by batteries also located within the spray gun. To produce a self contained unit, the liquid to be sprayed is preferably supplied from a pressurised cartridge, e.g. of the aerosol type, which fits into the spray gun and connects with the spray head assembly. The spray gun preferably includes a valve arrangement whereby the supply of liquid from the reservoir thereof, e.g. from the pressurised cartridge, to the spray head can be switched on and off.

The potential applied to the liquid may be positive or negative with respect to the target (and focussing electrode if used) and is preferably between 10 and 25, particularly 12 to 20, kV with respect thereto. One side of the high voltage generator output is preferably earthed while the other is connected to the nozzles: this connection to the nozzle may be made via conduction through the liquid. In the case of a handheld spray gun, while earthing of the one side of the generator output and of the focussing electrode, if used, can be achieved by conduction through the operator, it is preferred that such an "earth" connection is made by a wire from the spray gun which is clipped or otherwise fastened to the target or to a member in electrical communication with the target.

The spray head may be used for a wide variety of applications e.g. spraying paints, pesticides, polishes and other domestic and industrial liquids.

Figure 2:
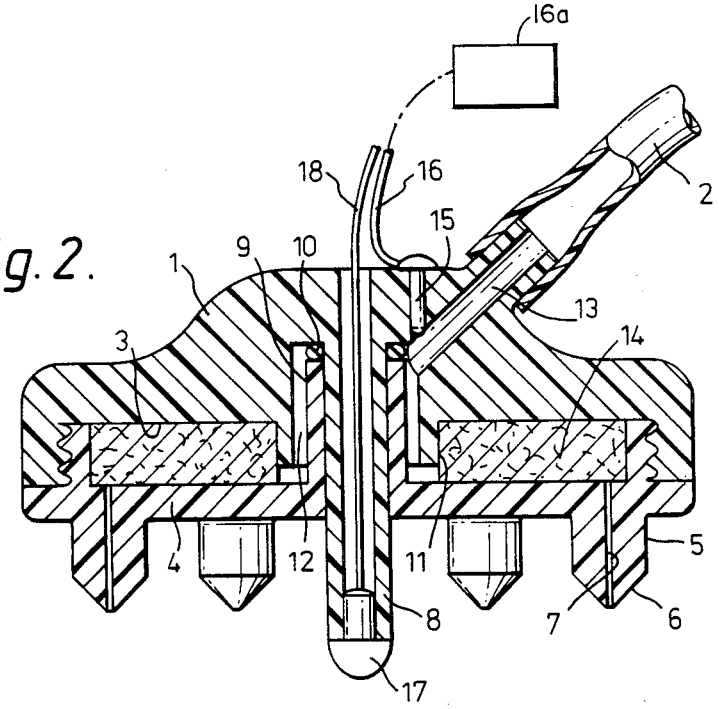
Figure 3:
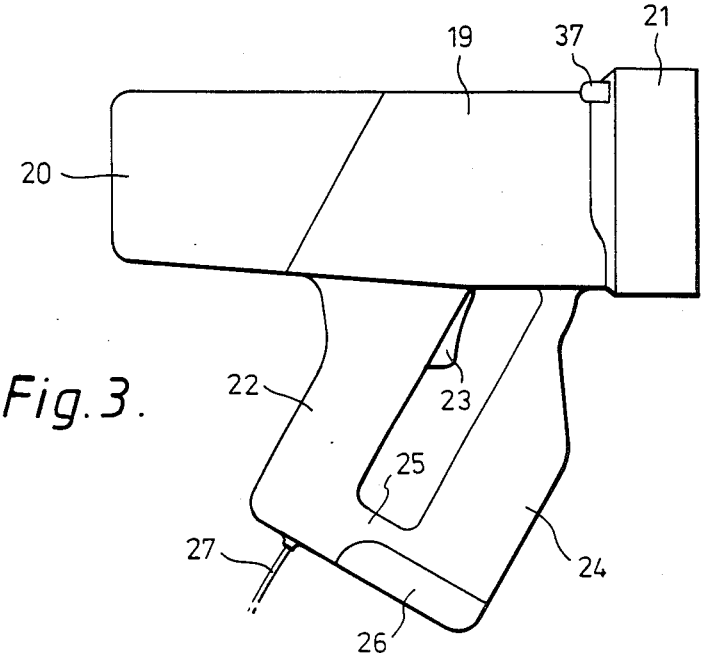
Figure 5:
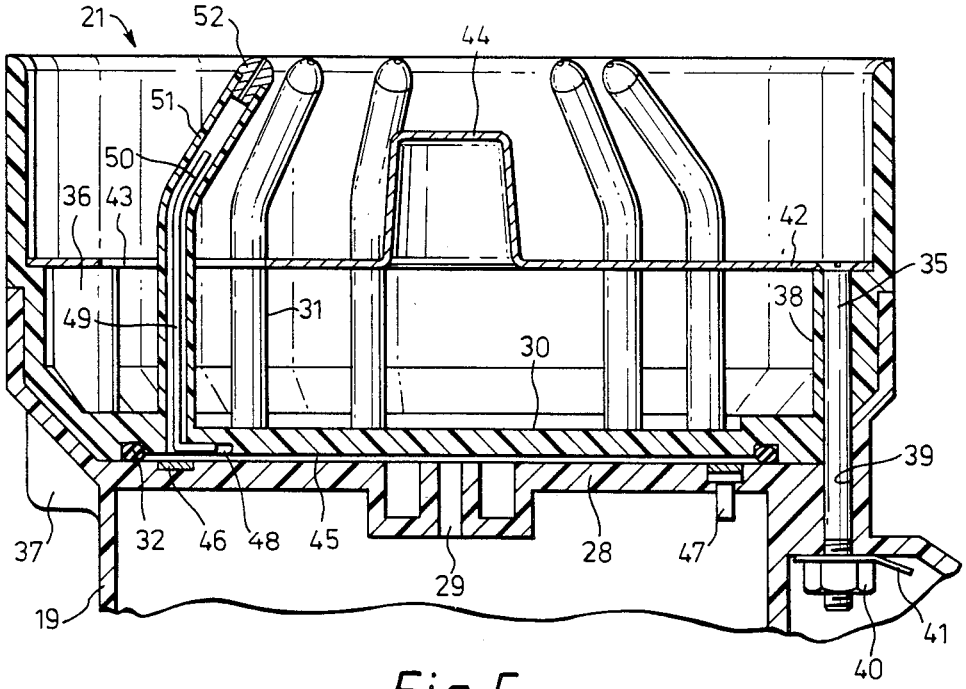
Figure 4:
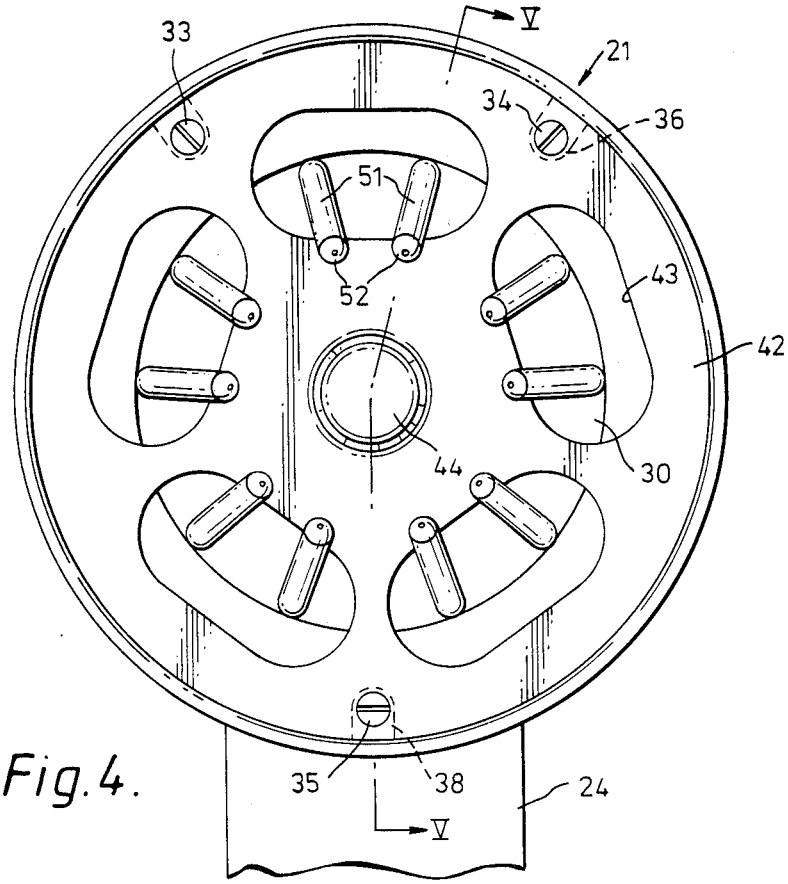
Figure 6:
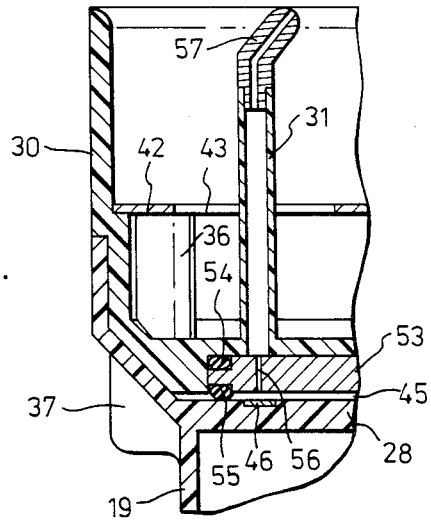

The invention is further illustrated by reference to the accompanying drawings wherein FIG. 1 is an end elevation of a spray head of a first embodiment, FIG. 2 is a section along the line II—II of FIG. 1, FIG. 3 is an elevation of a hand-held spray gun of a second embodiment, FIG. 4 is an end elevation of part of the spray of FIG. 3 showing the spray head, FIG. 5 is a section along the line V—V of FIG. 4, FIG. 6 is a section corresponding to FIG. 5 showing a modified form of flow restrictor.

Referring first to the embodiment of FIGS. 1 and 2, the spray head comprises a housing 1 formed from an electrically insulating material to which the liquid to be sprayed, e.g. paint, is supplied via a supply tube 2 from a pressurised reservoir (not shown). Screw mounted in a recess 3 in the underside of the housing 1 is a nozzle plate 4, also made of an electrically insulating material, provided with six nozzles 5 evenly disposed id hexagonal fashion on the circumference of a circle of diameter 8 cm. If the spray head is oriented so that said circle is in a vertical plane, the maximum possible vertical nozzle displacement is thus 8 cm. The maximum hydrostatic pressure difference between nozzles is thus $785\rho$ Pa where $\rho$ is the specific gravity of the liquid being sprayed.

Each nozzle 5 comprises a cylindrical protuberance from plate 4 provided with a conical end 6 and a small diameter bore 7 along the longitudinal axis of the protruberance. Each bore 7 typically has a length of 1 to 50 mm and a diameter of 0.5 to 2 mm but usually not more than 4 mm. Housing 1 is provided with a hollow, integral, projection 8 which extends through an opening in nozzle plate 4.

Nozzle plate 4 has a central sleeve 9 which fits over projection 8 and extends into housing 1 to seat against a sealing ring 10 located at the base of projection 8. Concentrically disposed round, but spaced from, sleeve 9 is an annular skirt 11 depending from housing 1. The skirt 11 and sleeve 9 thus define an annular passage 12 through which the liquid to be sprayed can pass en route to recess 3. The liquid is supplied to passage 12 via an inlet channel 13 connected to supply tube 2. A felt pad 14 is fitted on skirt 11 to fill the recess 3. The liquid thus has to flow through pad 14 to get to the bores 7 from passage 12.

Communicating with inlet channel 13 is an electrically conductive stud 15 to which a high potential can be applied via a lead 16 from a high voltage generator 16*a*. When the high potential is applied to stud 15, the charge is conducted through the liquid to give a high voltage gradient on the liquid at the exits of bores 7 to effect electrostatic atomisation of the liquid.

Projection 8 is provided at its end with a cap 17 of conductive material, e.g. metal, to which a lead 18 is connected. When lead 18 is maintained at a different potential to that applied to the liquid, cap 17 acts as a field modifying electrode. Preferably cap 17 is connected to earth so that it focusses the individual sprays from the nozzles 5 into a single spray.

The pressure applied to the liquid in the reservoir, and hence in supply tube 2 is such that, at the desired rate of flow, there is a large pressure drop across the felt pad 14 but negligible pressure drop downstream thereof, i.e. through bores 7. In this way the flow of liquid through the individual bores 7 is rendered uniform and unaffected by the spatial orientation of spray head. Typically the pressure drop across the felt pad is about 270 kPa with a liquid of viscosity $2\times10^{-2}$ Pa·s and at a flow rate per nozzle of $2\times10^{-8}$ $m^3 \cdot s^{-1}$. In this case calculation shows that $\alpha$ is $6.75\times10^{14}$ $m^{-3}$.

Since the maximum hydrostatic pressure difference between the nozzles is $785\rho$ Pa, where $\rho$ is the specific gravity it is seen that even with a liquid of specific gravity of 1.5 the pressure drop across the felt pad is about 230 times the maximum hydrostatic pressure difference between nozzles.

It will be seen from the construction of the spray head that it can easily be dismantled for cleaning and replacement of the felt pad 14.

In an alternative embodiment the felt pad is omitted and each bore 7 is filled with a fibre bundle, for example of the type employed in fibre-tip writing implements to act as the flow restricting means. Spraying can in fact take place from the ends of the fibre bundle.

In the embodiment of FIGS. 3–5, an arrangement suitable for spraying paint is illustrated.

The apparatus comprises a self-contained hand-held spray gun. The spray gun has a body 19 causing a pressurised cannister of paint 19*a* fitted at one end with a primary flow restrictor and an "aerosol" type valve whereby axial movement of the valve stem towards the cannister effects opening of the valve permitting paint to flow therethrough under the action of the pressurising medium. The body 19 has a cap 20 which can be removed to enable the cannister to be changed.

At the front of the body 19 there is provided a spray head assembly 21 shown in more detail in FIGS. 4 and 5.

Attached to the body 19 is a hand grip 22 provided with a trigger 23, and a housing 24 containing a high voltage generator powered by batteries within a housing 25 connecting housing 24 to the base of the hand grip 22. A removable cover 26 to housing 25 is provided to enable the batteries to be changed.

Depression of trigger 23 causes axial movement of the paint cannister towards the spray head 21 thus opening the canister valve. Depression of trigger 23 also completes the battery circuit thus switching the generator on. An earthing lead 27 is provided from the base of the hand grip 22. This lead connects within housing 24 to one side of the high voltage generator output. Trigger 23 is preferably of electrically conductive material and electrically connected to lead 27 to ensure that the operator is at the same "earth" potential.

Referring to FIGS. 4 and 5, the spray head comprises a moulding 28 of non-conducting plastics material formed integrally with body 19. The moulding 28 has a central orifice 29 into which the outlet stem of the cannister valve seats: movement of the cannister towards moulding 28 when trigger 23 is depressed thus effects axial movement, and hence opening, of the valve.

Located within moulding 28 is a second moulding 30 formed from a non-conducting plastics material. Moulding 30 is provided with ten integrally formed tubes 31 arranged in five pairs around the circumference of a circle. Moulding 30 is sealed against moulding 28 by means of an O-ring 32 and held in place by three bolts 33, 34, 35. Bolts 33 and 34 extend through bosses 36 (shown dotted in FIG. 4) in moulding 30 and engage with tapped bores in protruberances 37 in moulding 28. Bolt 35 extends through a boss 38 (shown dotted in FIG. 4) and through a bore 39 in moulding 28 and is secured by a nut 40 with a tag 41 between nut 40 and moulding 28. The "earth" side of the generator output, i.e. that side connected to lead 27, is connected to tag 41.

Bolts 33, 34, 35 also serve to hold in place a metal plate 42 provided with openings 43 through which the pairs of tubes 31 project. Plate 42 has a raised central portion 44 which acts as a focussing electrode and which is "earthed" via bolt 35, tag 41 and lead 27.

A disc-shaped recess 45 in the back of moulding 30 provides a path for paint flowing through the valve output stem engaging with bore 29 to the tubes 31. Located in a groove in the surface of moulding 28 inboard of O-ring 32 is a metal ring 46 which also contacts a metal stud 47 extending through moulding 28. The "high voltage", as opposed to the "earth", side of the high voltage generator output is connected to stud 47.

Adjacent each tube 31, moulding 30 is provided with a groove 48 extending radially inwards. Located in each tube 31 is a stiff metal wire 49 having a right-angled bend adjacent one end with the short limb of the bent wire seated in the groove 48 associated with that tube. The other end 50 of the wire is radially inwardly bent and serves to deform the outer end 51 of its associated tube 31 so that the outer end 51 of the tube is inclined radially inwards. The wire 49 also serves to form a flow restrictor within its associated tube 31 since only a narrow gap exists between the wire and the internal surface of the tube for the passage of the paint.

The outer end of each tube 31 is provided with a hemispherical metal nozzle member 52.

In use the paint flows outwardly through the disc-shaped recess 45 and then along each tube 31 past the flow restrictor formed by the wire 49, and thence from the nozzle 52. The high voltage necessary to effect atomisation is applied to the nozzle 52 via conduction from metal ring 46 through the liquid in tubes 31. The paint emerges from the nozzles 52 as inwardly directed ligaments which break up into fine electrically charged droplets. The earthed electrode 44 serves to assist atomisation.

In a modification, shown in FIG. 6, moulding 30 is recessed to accept a metal plate 53 which is sealed to moulding 30 by O-ring 54 and to moulding 28 by O-ring 55. A fine bore 56 at the entrance to each tube 31 provides the flow restrictor. In this arrangement, angled nozzles 57 may be employed to direct the emerging paint ligaments inwardly to augment the focussing effect of the central earthed electrode.

As an example an alkyd-based automobile refinish paint of specific gravity 1.01, resistivity $5\times10^{7}$ ohm.cm and $2\times10^{-2}$ Pa·s viscosity at 20° C. was used to spray a metal panel using the spray gun equipped with a spray head of the modified type shown in FIG. 6. The ten nozzles, which were each of hemispherical configuration of 3.5 mm diameter and having a 1 mm diameter orifice of length 5 mm, were positioned round the circumference of a circle of diameter 4.5 cm. The nozzles were directed towards a point about 6 cm in front of the "earthed" electrode 44. Each flow restrictor immediately preceding the entrance to each tube 31 consisted of a 0.355 mm diameter bore of 5 mm length.

The target metal panel was positioned about 50 cm in front of the "earthed" electrode 43 and was connected to lead 27. The high voltage applied was 13–14 kV and the paint flow rate was about 1 ml/minute ($1.7\times10^{-8}$ $m^3\cdot s^{-1}$) per nozzle.

Various spatial orientations of the spray gun, i.e. spraying horizontally or vertically downwards, were employed with no discernable difference in performance.

Even in the hands of an unskilled paint sprayer the finish quality was as good as that given by a professional paint sprayer using a compressed air driven spray gun. In particular the paint finish was notably free of common faults such as "orange-peel", running, sagging, and blistering. The finish was far superior to that given by an aerosol "touch-up" paint spray.

With the type of flow restrictor used in this example the pressure drop across each restrictor is given by $$P=(8Q\,l\eta)/(\pi r^4)$$

where Q is the flow rate, l is the length of the flow restrictor $\eta$ is the viscosity of the paint and r is the radius of the flow restrictor bore.

Calculation shows that in this example each flow restrictor had an $\alpha$ value (as hereinbefore defined) of $1.27\times10^{13}\,m^{-3}$: in this instance $\alpha=(8\,l)/(\pi r^4)$. Calculation also shows that the pressure drop across each flow restrictor was about 4.2 kPa whereas the maximum hydrostatic head between the nozzles is $h\rho g$ where h is the maximum vertical distance between the nozzles, $\rho$ is the paint density and g is the acceleration due to gravity.

Since in this example h was 4.5 cm, the maximum hydrostatic head was about 0.45 kPa. Hence the pressure drop across each flow restrictor was over nine times the maximum hydrostatic head.

I claim:

1. A method of electrostatically spraying a liquid from a plurality of nozzles comprising feeding said liquid from a common source under superatmospheric pressure, dividing said liquid via distributing means to form a plurality of streams, restricting the flow of each of said streams at, or downstream of, said distributing means by a flow restrictor, such that the pressure drop on each of said liquid streams across the flow restrictor is substantially greater than that given by the hydrostatic head corresponding to the maximum possible vertical displacement of said nozzles, feeding each of said liquid streams through a nozzle at a rate not exceeding $5\times10^{-8}\,m^3\cdot.s^{-1}$, and applying to each of said nozzles an electrical potential of such magnitude that said liquid emerging from said nozzles is atomized into electrically charged droplets.

2. A method according to claim 1 wherein the liquid flow rate through each nozzle is below $3\times10^{-8}\,m^3\cdot s^{-1}$.

3. A method according to claim 1 wherein the pressure drop across each of the flow restrictors is at least five times that given by the hydrostatic head corresponding to the maximum possible vertical displacement of said nozzles.

4. A method according to claim 1 wherein the pressure drop across each flow restrictor is at least 2000 Pa.

5. A spray head for electrostatic spraying having a plurality of nozzles, means to supply liquid to be sprayed to the nozzles, and means to apply a high electrical potential to the liquid emerging from the nozzles, said liquid supply means including means to distribute said liquid, provided under superatmospheric pressure, from a common source, to the nozzles via flow restricting means disposed at, or downstream of, said flow distributing means, whereby said flow restricting means provides a flow restrictor in each of the paths from said common source to the nozzles, and wherein, at least for liquids of viscosity between $10^{-3}$ and $10^{-1}$ Pa·s and at flow rates through said flow restrictor below $5\times10^{-8}$ $m^3\cdot s^{-1}$, each of said flow restrictors has a value of $\alpha$ of at least $5\times10^{12}\,m^{-3}$ where $\alpha$ is defined as $$\alpha=P/(Q\cdot\eta)$$

where P is the pressure drop, expressed in Pa, given across the flow restrictor by a liquid of viscosity $\eta$ expressed in Pa·s at a flow rate of Q $m^3 \cdot s^{-1}$.

6. A spray head according to claim 5 wherein there are at least six nozzles.

7. A spray head according to claim 5 wherein the distance between the nozzles furthest apart is between 3 and 10 cm.

8. A spray head according to claim 5 wherein the nozzles are disposed around the circumference of a circle.

9. A spray head according to claim 8 wherein an earthed electrode is provided at the centre of said circle.

10. A spray head according to claim 8 wherein the nozzles are inclined radially inwardly.

11. A self contained electrostatic spray gun incorporating a spray head according to claim 5, a battery powered high voltage generator, and means to apply the high voltage from one side of the generator output to said nozzles and to connect the other side of the generator output to earth.

12. A spray gun according to claim 11 incorporating a replaceable pressurised cartridge of the liquid to be sprayed.

* * * * *